US005890531A

United States Patent [19]

Gairns et al.

[11] Patent Number: 5,890,531

[45] Date of Patent: Apr. 6, 1999

[54] APPARATUS FOR THE SELF-CLEANING OF PROCESS TUBES

[75] Inventors: Stuart A. Gairns, Burnaby; John Joustra, Vancouver, both of Canada

[73] Assignee: Noram Engineering and Constructors Ltd., Vancouver, Canada

[21] Appl. No.: 931,520

[22] Filed: Sep. 16, 1997

Related U.S. Application Data

[63] Continuation of Ser. No. 746,538, Nov. 13, 1996, abandoned, which is a continuation of Ser. No. 424,013, Apr. 18, 1995, abandoned.

[51] Int. Cl.[6] ..... F28G 9/00

[52] U.S. Cl. ..... 165/95; 165/94; 15/3.51

[58] Field of Search ..... 165/95, 94; 15/3.51

[56] References Cited

U.S. PATENT DOCUMENTS

| | | | |
|---|---|---|---|
| 3,425,083 | 2/1969 | Wennerberg et al. | 15/104.06 |
| 3,883,431 | 5/1975 | Ishii et al. | 210/34 |
| 4,198,293 | 4/1980 | Ogawa et al. | 210/23 H |
| 4,420,038 | 12/1983 | Okouchi et al. | 165/95 |
| 4,435,285 | 3/1984 | Okouchi et al. | 165/95 X |
| 4,566,533 | 1/1986 | Bochinski et al. | 165/95 |
| 4,607,410 | 8/1986 | Bersch | 15/3.51 |
| 4,620,589 | 11/1986 | Koller | 165/95 |
| 4,865,121 | 9/1989 | Ben-Dosa | 165/95 |
| 4,917,176 | 4/1990 | Shimada et al. | 165/95 |
| 5,072,476 | 12/1991 | Bersch | 15/3.51 |
| 5,086,833 | 2/1992 | Ben-Dosa | 165/95 |
| 5,176,204 | 1/1993 | Ben-Dosa | 165/95 |
| 5,252,224 | 10/1993 | Modell et al. | 210/695 |
| 5,388,636 | 2/1995 | Peery | 165/95 |

FOREIGN PATENT DOCUMENTS

| | | | |
|---|---|---|---|
| 1247359 | 8/1967 | Germany | 165/95 |
| 0180896 | 8/1986 | Japan | 165/95 |
| 1051367 | 10/1983 | U.S.S.R. | 165/95 |
| 1586801 | 8/1990 | U.S.S.R. | 165/95 |

OTHER PUBLICATIONS

Pipeline Pigging Technology, Tiratsoo, J.N.H., editor, Gulf, Houston, 1988.

Kipin, Peter, "Cleaning Pipelines: a Pigging Priemer", Chem.Eng. Feb. 4, 1985, pp. 53–58.

Someah, Kaveh, "On–Line Tube Cleaning: the Basics", Chem. Eng. Prog., Jul., 1992, pp. 39–45.

*Primary Examiner*—Ira S. Lazarus
*Assistant Examiner*—Christopher Atkinson
*Attorney, Agent, or Firm*—Bell, Boyd & Lloyd

[57] ABSTRACT

Periodic self-cleaning apparatus of use in combination with a process tube which receives a process fluid therethrough such as a tubular reactor to form a looped system having a launching and receiving chamber for a cleaning device or pig which is propelled periodically through the tube by the motive force of the fluid to clean the tube without disrupting the continuous unidirectional flow of the fluid. The pig need not be spherical and extraneous fluid pumps are not needed.

9 Claims, 8 Drawing Sheets

APPARATUS FOR THE SELF-CLEANING OF PROCESS TUBES

This application is a continuation of application Ser. No. 08/746,538, filed Nov. 13, 1996, now abandoned, which is a continuation of application Ser. No. 08/424,013, filed Apr. 18, 1995, now abandoned.

FIELD OF THE INVENTION

This invention relates to the mechanical cleaning of process tubes, such as tubular reactors and heat exchangers, by cleaning members introduced into the tube and propelled therethrough by fluid.

BACKGROUND OF THE INVENTION

Tubular equipment, tubes and pipes, which are taken to be synonymous in this specification, are used in industrial, commercial, residential, and municipal applications for many different purposes ranging from transport of drinking water to processing mixtures of toxic chemicals.

One such use of tubular equipment is for the transport of fluids, such as gases, liquids, mixtures of gases and liquids, and slurries comprising mixtures of liquids and solids. In many cases, deposits of solid material accumulate on the walls of the tube and restrict fluid flow therethrough. This increases the power required to transport the fluid, see for example, Kipin, Peter, "Cleaning Pipelines: a Pigging Primer", Chem. Eng., Feb. 4, 1985, pp 53–58. Examples of this type of behavior are the build-up of paraffin waxes on the inside of pipes used to transport petroleum products described in Pipeline Pigging Technology, Tiratsoo, J. N. H., editor, Gulf, Houston, 1988 and the build-up of iron oxide corrosion products on the inside of steel water pipes described in aforesaid Kipin, Peter, "Cleaning Pipelines: a Pigging Primer".

Another common use for tubes is as heat exchange equipment in the indirect heating or cooling of fluids and fluid-solid mixtures through the wall of the tube. It is common during these processes for an insoluble scale to form on the inside of the tube due to a change in solubility of solute in the fluid due to a change in temperature by heating or cooling, as described in Someah, Kaveh, "On-Line Tube Cleaning: the Basics", Chem. Eng. Prog. July 1992, pp 39–45. A common example of this is the heating of water in water-cooled steam-condensers in power plants. As the cooling water in the tube is heated by condensing steam the solubility of certain inorganic salts such as calcium carbonate and calcium sulphate is decreased and these salts precipitate out of the water and accumulate on the tube wall. Heat sensitive materials when heated through the tube wall sometimes will foul the inside of tubes when the material is chemically altered by overheating. The caramelization of sugar solutions during heating is an example of this common problem.

In addition to causing an increase in flow resistance and, thus, power required to maintain the flow, the build-up of scale and other forms of fouling greatly impairs the transfer of heat to the fluid through the fluid wall. Said impairment of heat transfer necessitates that larger and more expensive equipment be employed, compared to operation without scale or fouling.

Tubes are also used to provide residence time for reacting flows of fluids and fluid-solid mixtures. In such reacting systems it is often the case that solids will build-up on the wall of the pipe due to settling of solids from the suspension, precipitation of a reaction product, or a reduction in solubility of a non-reacting component in the stream due to a change in fluid temperature in the reactor. An example of a reacting system which exhibits the latter phenomena is supercritical water oxidation of organic wastes containing inorganic material as described in U.S. Pat. No. 5,252,224—Modell et al, issued Oct. 12, 1993. In the process described in U.S. Pat. No. 5,252,224, the reaction is carried out under adiabatic conditions. As the reaction progresses, the heat of reaction raises the fluid temperature and inorganic salts tend to precipitate out of the fluid phase and have been known to cause build-up of solids in tubular reactors. Such build-up of solids leads to an increase in flow resistance and, thus, an increase in the consumption of energy for the transport of fluid through the reactor. If these solids are allowed to continue to accumulate, complete plugging often occurs and results in the costly event of lost production from the facility.

The use of cleaning members or pigs for the purpose of cleaning tubular equipment, such as pipelines and municipal and industrial process piping and equipment is well known. Cleaning members are used to remove both liquid and solid material from the lines and are usually propelled by a fluid through the hydraulic forces exerted on the cleaning member by the flowing fluid.

In the cleaning of petroleum pipelines a cleaning member known as a pig is introduced in the pipeline at a pig launching station and moved through the pipeline by the hydraulic force exerted by a motive fluid, usually the petroleum product transported through the line. Some distance downstream, the cleaning member is received into a pig receiving or catching station. A pig can be loaded into a pig launcher, manually or automatically and similarly unloaded from the pig receiver manually or automatically. However, the pig must be transported back upstream to the launching station by independent means, usually by surface transport.

In the chemical, food, and related process industries pigs are known to be used to clean process tubes and to act as a barrier between fluids so that a single tube can be used to transport several different fluids or fluid-solid mixtures without intermixing of the fluids. In such systems pigs are often introduced and withdrawn from the tubes using pig launchers and catchers in the same manner as described above for petroleum pipelines. In alternative systems, pigs are launched and received by the same device by reversal of the direction of flow of the motive fluid in the tube as described in U.S. Pat. No. 3,883,431—Ishii et at, issued May 13, 1975, U.S. Pat. No. 4,198,293—Ogawa et al, issued Apr. 15, 1980, U.S. Pat. No. 4,607,410—Bersch, and U.S. Pat. No. 5,072,476—Bersch, issued Dec. 17, 1991. It is known that such systems can be automated to periodically reverse the flow of the fluid through the tube, and by using a launching and receiving device at each end of the tube the cleaning member can periodically be pushed through the tube by the fluid in alternating directions. Unfortunately, for many of the flow systems which use tubes and require periodic cleaning, the periodic reversal of flow through the tube is not tolerable and thus this method cannot be used.

Methods are known using the continuous circulation of rubber cleaning balls through process tubes, for example, U.S. Pat. No. 4,620,589—Koller, issued Nov. 4, 1986, U.S. Pat. No. 4,566,533—Bochinski et al, issued Jan. 28, 1986, U.S. Pat. No. 5,086,833 Ben-Dosa, issued Feb. 11, 1992. In these methods, such balls are loaded into the entrance of the process tube by an automatic loading device and pushed through the tube by the hydraulic force of the process fluid on the balls out through an exit. After the exit of the tube the balls are separated out of the process fluid by a screening device and automatically removed from the process to a recirculation system which returns the balls to the automatic loading device. Unfortunately, the use of such cleaning systems is limited to process conditions which are compatible with the material of construction, such as rubber, of the balls, and as such cannot be used to clean systems operating at high temperature or under other conditions which are detrimental to the rubber. In addition, the methods and apparatus used for loading, removing, and recirculating the cleaning members are only useful when the cleaning member is essentially spherical.

U.S. Pat. No. 3,425,083—Wennerberg et at, issued Feb. 4, 1969 describes a device for cleaning an endless tube. The operation of this device requires that the flow of fluid through the tube is greater than the flow entering and exiting the system, such that a portion of the fluid that has passed through the tube is recirculated from the "end" of the loop to the "beginning" of the loop allowing recirculation of the cleaning member. Eduction of this recirculating fluid is effected with a second large flow recirculation loop and pump. In addition to requiring substantial energy to effect the eduction of the recirculating liquid, this device is deficient in that a large portion of the fluid exiting the tube must be mixed with the feed to the system.

In addition to the pigging methods described above, which can be employed in some circumstances to effect tube cleaning without the interruption of fluid flow, methods exist to clean tubes which require the tubes to be taken out of useful service. These methods include mechanical means such as bristle brushes, rubber plugs, scrapers, cutters, vibrators, and water lances. These methods have the undesirable feature that they require the process tube and attached equipment to be taken out of service during the cleaning operation, and in addition often require that the equipment be partially disassembled prior to cleaning. An additional method which also requires the tube to be taken out of service is cleaning by chemical means. For example, many types of scale which form on heat exchanger tubes can be removed by washing the tube with nitric acid. Chemical cleaning methods have the further disadvantage of requiring disposal, or clean-up and recycle, of the cleaning chemicals.

It is therefore clear that there exists a need for a system which will allow the cleaning of a process tube by tube cleaning members on a periodic basis, without disrupting the continuous unidirectional flow of the process fluid through the tube, without being limited to the use of spherical rubber cleaning members, without requiring mixing of the inlet and outlet streams, and without requiring an additional pump to provide the means of recirculating the cleaning members.

SUMMARY OF THE INVENTION

The present invention is for use with process tubes, such as tubular reactors and heat exchangers, in which it is beneficial or essential to maintain unidirectional continuous flow of the process fluid through the process tube during a cleaning operation and wherein the cleaning member is recycled from the exit of the process tube back to the entrance of the process tube so that the cleaning member may again be launched into the process.

It is, thus, an object of the present invention to provide a self-contained apparatus of use in combination with a process tube for the self-cleaning thereof.

It is a further object of the present invention to provide a looped system comprising a process tube having novel means for launching, receiving and holding a recycling tube cleaning member for the process tube without disrupting the continuous unidirectional flow of fluid through the process tube. The cleaning member is propelled through the tube by a motive fluid, and is not restricted to the use of spherical cleaning members as are many of the previously known methods for recycling cleaning members.

It is a yet further object of this invention to provide novel arrangements of valves, conduit and lines to allow, optionally, fluid exiting the process tube, the fluid entering the process or a separate motive fluid to be used to recycle the cleaning member from the cleaning member receiving chamber to the cleaning member launching chamber, thus eliminating the need for an additional pumping device for this purpose.

Accordingly, in its broadest aspect the invention provides apparatus of use in combination with a process tube for the periodic cleaning of said process tube, said process tube having feed process fluid supply means for receiving a feed process fluid and discharge process fluid discharge means for discharging process fluid; said apparatus comprising a cleaning member;

a cleaning member recycling conduit in communication with said process tube to form a recycle loop therewith, said conduit and said process tube being adapted to receive said cleaning member to allow said member to operably circulate therethrough under process fluid flow to effect cleaning of said process tube; wherein said recycling conduit has a first valve means and a second valve means defining therebetween with a portion of said conduit a cleaning member receiving, holding and launching chamber.

Preferably, the apparatus comprises apparatus as hereinabove defined further comprising second feed process fluid supply means in communication with said chamber and second discharge process fluid discharge means in communication with said chamber.

The novel arrangements of lines and valves allows the chamber to be used for both cleaning member launching and for receiving, whereby the cleaning member travels unidirectionally through this launching and receiving chamber.

In a preferred embodiment, the invention provides a novel means of recycling a cleaning member such that the fluid discharged from the system is not mixed with the inlet feed process fluid.

In an alternative embodiment the invention provides a novel means of recycling a cleaning member by which there is neither mixing of the discharge fluid into the inlet feed fluid nor mixing of the inlet feed fluid into the discharge exit fluid.

The valves can be actuated automatically.

The process tube to be cleaned must itself be configured such that a cleaning member can pass freely from the start of the tube to the end thereof with the process fluid providing the motive force. Thus, the difference in pressure between the supply of process fluid to the system and the discharge of process fluid from the system must be sufficient to effect flow of the process fluid through the tube as well as to effect flow of the fluid through the system and propulsion of the cleaning member through the process tube, simultaneously. Further, when the selected valves of the apparatus are open, the fluid flow provides the motive force to move the cleaning member through the process tube and the recycling conduit. The apparatus of the present invention, thus, has or is associated with fluid pump means for providing feed process fluid under pressure to force the fluid through the process tube and, optionally, through the recycling conduit.

By the term "pump means" in this specification is meant means for effecting fluid flow through the process tube and recycling conduit either directly by a pump associated with the apparatus of the invention, or, indirectly, for example by the creation of a head of fluid pressure as in an elevated tank. Since operation of the pig will, typically, only add a very small incremental pumping energy requirement, no additional pig cycling pump means is necessary. Cleaning/flushing fluid, typically water, will generally be provided under pressure from its source, external of the apparatus.

The ends of the cleaning member recycling conduit are, thus, connected to the end of the process tube and the start of the process tube such that when all the valves in the conduit are open, the process tube and conduit form a continuous self-contained loop. This loop provides the path by which the cleaning member travels through the process tube and is recycled unidirectionally. The start and end of the process tube will, preferably, be such that the majority of the length of the loop is occupied by the process tube with only a relatively short length of tube occupied by the recycling section. The fluid supply means and discharge means are so formed and arranged as to prevent the cleaning member from passing therethrough out of the apparatus.

A minimum of two valves, forming a minimum of one chamber, or a plurality of discrete chambers in series as hereinafter described, between the valves, with each chamber formed being at least as long as the cleaning member to be used, are provided in the recycling section to facilitate redirection of the flow of the process fluid and launching and receiving of a cleaning member.

The supply of the process fluid is connected, by separate lines, to both the start of the process tube and to the upstream end of that chamber in the recycling section which is used as the cleaning member launching chamber. Connections are made in such a manner as to not obstruct or divert the path of a cleaning member from moving through the aforementioned loop. Each line is provided with a valve to facilitate redirection of the fluid flow during the cleaning member launching cycle.

The process discharge point is connected, using separate lines, to both the end of the process tube and the downstream end of the chamber in the recycling section which forms the selected cleaning member launching chamber. Connections are also made in such a manner as to not obstruct the path of a cleaning member moving through the aforementioned loop. Similarly, the lines are equipped with a valve to facilitate redirection of the fluid flow during the receiving of the cleaning member. In the case that a single chamber is used to both launch and receive the cleaning member, means may be provided to flush the process supply fluid from the chamber after cleaning member launching and prior to cleaning member receiving, such that the process discharge fluid is not contaminated with the process inlet fluid. In one embodiment, the flushing is effected by connecting a cleaning or flushing fluid supply line and associated valve to the upstream end of the launching and receiving chamber and a flushing discharge tube and valve to the downstream end of the launching and receiving chamber. The flushing fluid can be a separate fluid or it can be the process discharge fluid itself. The fluid flushed from the process may be collected and disposed or returned to the start of the process for reuse.

Accordingly, in a preferred aspect the invention provides apparatus as defined hereinabove further comprising cleaning fluid supply means in communication with said chamber and comprising a cleaning fluid supply line, cleaning fluid supply chamber inlet means and cleaning fluid supply valve means, cleaning fluid discharge chamber outlet means, cleaning fluid discharge line and cleaning fluid discharge valve means.

The cleaning fluid supply line may be in communication with the recycling conduit, optionally, either upstream or downstream of the chamber.

Operation of the embodiment in which a single chamber is used to both launch and receive the cleaning member proceeds as follows. With a cleaning member in the launching and receiving chamber and the process fluid flowing from the supply point to the discharge point directly through the process tube, the flow valves are operated such as to launch the member into the process tube. After the member has been launched and is traversing the process tube, and in the case that the chamber is to be flushed prior to receiving the cleaning member, the flow valves are now operated to flush the chamber. While the cleaning member continues to travel through the process tube, the flow valves are again operated to receive the cleaning member in the chamber. The cleaning member is then received in the chamber and the flow valves are operated to effect normal flow of the process fluid from the supply through the process tube to the discharge point, without flowing through the recycling section. In the case that it is not acceptable to mix the process discharge fluid with the process supply fluid, the flow valves are again operated to flush the launching and receiving chamber, this time with either a separate flushing fluid or with process supply fluid. The chamber is then isolated again by operating the flow valves, so that the cleaning member is ready for another cleaning cycle.

In the cases that either the cleaning member transit time through the tube is so short that there is insufficient time to change the flow configuration from a launching to receiving mode during transit or that it cannot be tolerated that the process discharge fluid comes into contact with chambers that have been in contact with the process supply fluid, separate launching and receiving chambers are provided. When separate launching and receiving chambers are provided, the operation of the embodiment proceeds as follows. With a cleaning member in the launching and receiving chamber and the process fluid flowing from the supply point to the discharge point directly through the process tube, the flow valves are operated such as to route the process fluid from the end of the process tube through the receiving chamber and back to the process discharge. Next, the flow valves are operated such as to route the process fluid from the supply point through the launching chamber and back to the start of the process tube, such as to effect the launching of the cleaning member. After the member has been launched, has travelled through the process tube and has been received in the receiving chamber, the flow valves are operated so as to re-establish flow directly from the supply through the process tube to the process discharge. In the case that the process supply fluid cannot be contaminated by the process discharge fluid, the flow valves are then operated so as to flush the receiving chamber with an acceptable fluid. Next in the operating sequence the flow valves are operated to push the cleaning member from the receiving chamber to the launching chamber, with an acceptable fluid, and then the flow valves are operated so as to again isolate the cleaning member in the launching chamber so that it is ready for another cleaning cycle.

The cleaning member may be formed of any suitable material, including the same material as is the process tube as described, for example, in aforesaid U.S. Pat. No. 5,252,224 in the oxidation of organic materials under pressure and temperature values supercritical for water, which description is incorporated herein by reference.

The cleaning member is periodically replaced with a new or refurbished cleaning member by either automatically or manually removing and inserting cleaning members into the launching or receiving chamber.

In more preferred embodiments of the invention, the operation of the flow valves are automated and controlled by an external electronic device, preferably a programmable logic controller.

The apparatus of the invention is of particular value when the process tube is an elongate tubular reactor. One such tubular reactor is of the type described in aforesaid U.S. Pat. No. 5,252,224 suitable for the oxidation of organic material with a source of oxygen in an aqueous reaction mixture at least at the critical temperature and critical pressure for water.

Accordingly, the invention further provides apparatus as hereinabove defined wherein said process tube is an elongate tubular reactor, and more preferably, when the elongate tubular reactor apparatus comprises means for the oxidation of organic material with a source of oxygen in an aqueous reaction mixture at least at the critical temperature and critical pressure of water; and means for feeding said aqueous reaction mixture and said source of oxygen to said tubular reactor.

BRIEF DESCRIPTION OF THE DRAWINGS

In order that the invention may be better understood, preferred embodiments will now be described, by way of example only, with reference to the accompanying drawings, wherein.

and wherein in the drawings, the same numerals denote like parts.

DETAILED DESCRIPTION OF THE PREFERRED EMBODIMENTS

Figure 1:
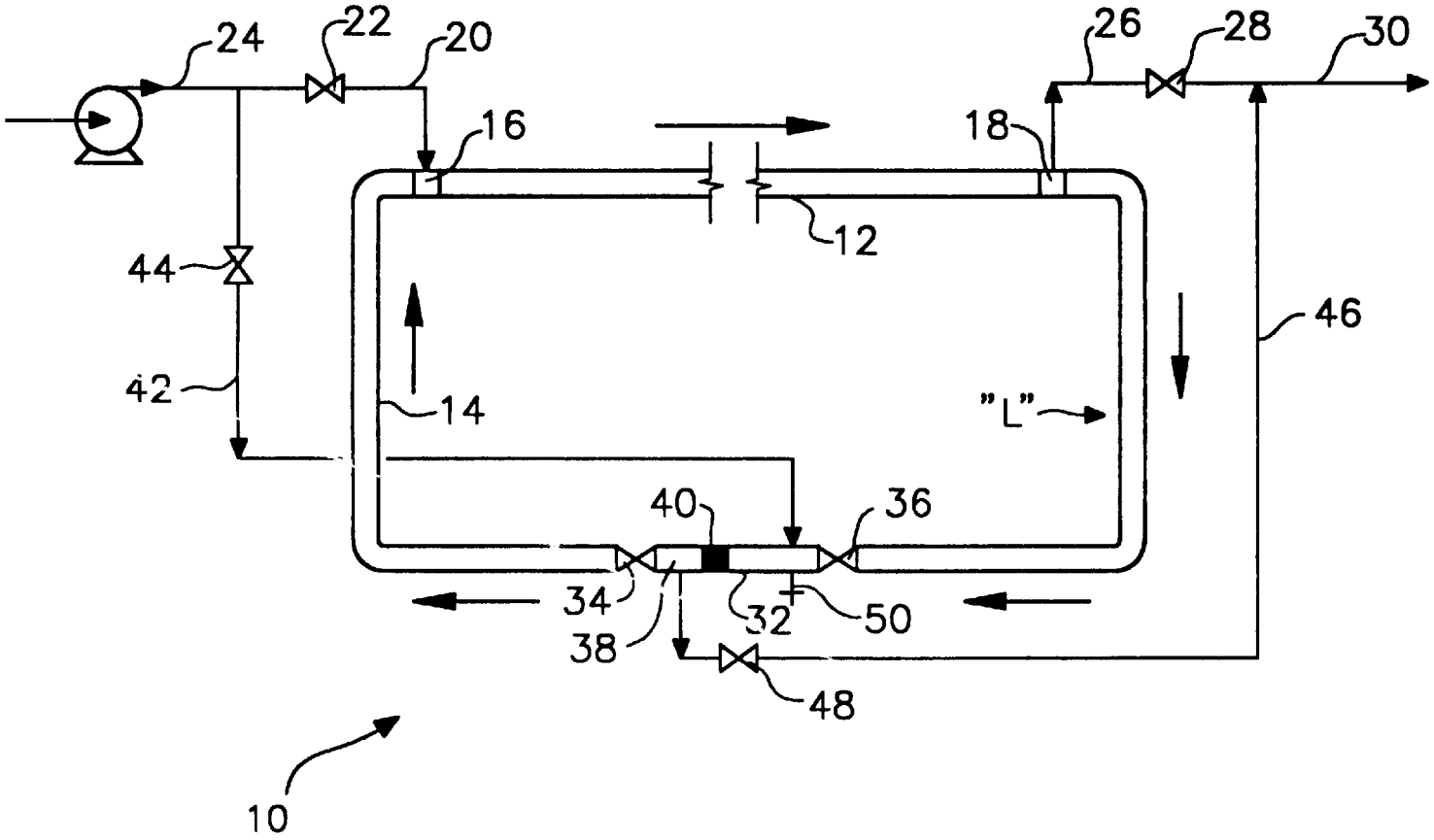
FIG. 1 is a diagrammatic layout of an embodiment of the present invention.

With reference to FIG. 1, this shows generally as 10, apparatus comprising in combination a process tube 12 connected to a recycle conduit 14 to constitute a continuous, recycle loop L. Tube 12 has a supply process fluid inlet 16 and a discharge process fluid outlet 18. Inlet 16 supplies fluid feed via a feed line 20 controlled by a valve 22 from a main feed line 24. Outlet 18 discharges fluid to an outlet line 26 controlled by a valve 28 to a main outlet line 30.

Conduit 14 at a portion 32 has a launch valve 34 and receiving valve 36 disposed therefrom, which valves 34 and 36 with portion 32 define a cleaning member launching and receiving chamber 38. Tube 12 and conduit 14 are of such size as to be able to receive and allow a cleaning member 40 to circulate through loop L under the influence of the process fluid. Further, member 40 is so shaped as to cause intimate contact with any material deposited on the inside of tube 12 to effect removal of such deposited material therefrom. In the embodiment shown, member 40 is within chamber 38. Member 40 is, in this embodiment shown a sponge rubber ball. Alternative pigs may be a cleaning brush, or any of the other numerous devices known to be effective for cleaning tubes, whereby such devices can be pushed through the tube by the normal flow of process fluid as described in the hereinbefore described prior art.

A second conduit feed line 42, under control of a valve 44, connects main feed line 24 with chamber 38. A second conduit fluid discharge line 46, under control of a valve 48, connects chamber 38 with main outlet line 30. The connecting points between line 42 and chamber 38 and line 46 and chamber 38 are such that cleaning member 40 cannot pass from chamber 38 to either line 42 or line 46. This is accomplished, for example, by guide bars over the connecting points, as described in aforesaid Tiratsoo, J. N. H. reference, such that fluid and debris removed from the pipe walls can flow between the rods whereas the cleaning member is too large to pass between the rods.

Chamber 38 has a drain plug 50 through which chamber 38 may be drained of fluid. In the embodiment shown, member 40 is inserted into or removed from chamber 38 by disassembly of the connections between valve 36 and conduit 14 or valve 34 and conduit 14.

The apparatus according to the invention shown in FIG. 1 is suitable for those processes in which it is acceptable to have a portion of the supply process fluid mix with a portion of the process fluid discharged to outlet line 30, in which it is acceptable to mix a portion of the discharge process fluid with a portion of the fluid supplied to process tube 12, and for which the transit time of cleaning member 40 in process tube 12 is substantial such that the required operation of the valves as hereinafter described, can be performed while member 40 is travelling through process tube 12.

Thus, the apparatus is suitable for those processes which meet the following three criteria. First, it is acceptable for process supply fluid which comes to be in chamber 38 during operation of the apparatus, as described hereinafter, to exit the apparatus unprocessed from chamber 38 via line 46 and 30. Second, it is acceptable for process discharge fluid that comes to be in chamber 38 during operation of the apparatus, as described hereinafter, to flow back to process tube 12 via conduit 14 to mix with process supply fluid. Third, wherein the duration of time required for cleaning member 40 to traverse the length of process tube 12 is substantial, such that the required operation of the valves as hereinafter described can be performed while member 40 is travelling through process tube 12.

An example of an application for use of the embodiment shown in FIG. 1 is the periodic cleaning of a steam condenser having a long tubular cooling coil constituting process tube 12, in which hard cooling water flows therethrough to cool the hot surfaces of tube 12. Cold cooling water is supplied through line 24 and heated cooling water is discharged through line 30. The embodiment shown in FIG. 1 is beneficial in that cleaning member 40 is used to remove hard water scale formed on the inside walls of cooling water coil 12, thereby effecting improved heat transfer and reduced pumping requirements. In this embodiment, it is not detrimental to discharge a portion of cooling water from chamber 38 via lines 46 and 30, and neither is it detrimental to allow a relatively small volume of warm cooling water contained in chamber 38 to flow back to the beginning of cooling coil 12 via conduit 14.

Process supply fluid is provided by upstream equipment through feed lines 24 and 20 under control of valve 22 through inlet 16 to process tube 12. The pressure of the fluid in line 24 is sufficiently greater at all times than the pressure of the fluid in line 30 so as to effect flow of fluid through the system in the direction shown by the arrows and being sufficient during cleaning cycles, as hereinafter described, to effect the flow of fluid through the system and the propulsion of cleaning member 40 through process tube 12 simultaneously.

In operation, wherein the fluid is either gaseous or liquid, cleaning member 40 is inserted into launching and receiving chamber 38. Normal process operation is carried out by first closing valves 34, 36, 44 and 48 and then opening valves 22 and 28, such that process fluid enters process tube 12 at 16, via lines 24 and 20, travels through process tube 12 and flows to discharge via lines 26 and 30 after exiting outlet 18. Periodically, when desired after sufficient period of processing action in tube 12, cleaning of tube 12 is carried out as follows.

To effect launching of cleaning member 40 from chamber 38, valves 34 and 44 are opened followed by closing of valve 22. This forces fluid through line 42 to chamber 38 and propels member 40 out of chamber 38 and through downstream portion of conduit 14 into process tube 12. After member 40 has entered tube 12, which event is determined by an appropriate sensing device or viewing window (not shown), valve 22 is reopened and followed by closing of valves 34 and 44. This effects re-establishment of the process supply fluid flow directly to process tube 12 through line 20 while member 40 is travelling through and cleaning process tube 12.

In preparation for receiving member 40 in chamber 38, valves 36 and 48 are opened followed by the closing of valve 28. This re-directs process discharge fluid through chamber 38 through line 46 to line 30. Member 40, after travelling the length of tube 12, is thus propelled by process fluid into chamber 38 and comes to rest against the rear of valve 34. Any debris which has been removed from tube 12 and pushed therethrough by member 40 is carried away by process fluid through lines 46 and 30 to a process discharge point out of line 30.

After member 40 has been received in chamber 38, which event is detected by an appropriate sensing device or viewing window (not shown), normal process flow is re-established by opening valve 28 followed by closing valves 36 and 48. Thus, at this point a cleaning and recycling cycle has been completed and the system is ready for another cleaning cycle when required.

Periodically, as wear, corrosion and other detrimental effects dictate, member 40 is replaced either manually or through use of an automatic loading and unloading device (not shown) associated with chamber 38.

The embodiment shown in FIG. 1 can be modified to provide means to allow flushing of undesirable fluids from chamber 38 either while cleaning member 40 is travelling through process tube 12 or while cleaning member 40 is in chamber 38. Flushing is advantageous when it is not desirable to mix a portion of the process feed fluid with a portion of the process fluid discharged to outlet line 30 or when it is not desirable to mix a portion of the process discharge fluid with a portion of the process fluid supplied to process tube 12.

Figure 2:
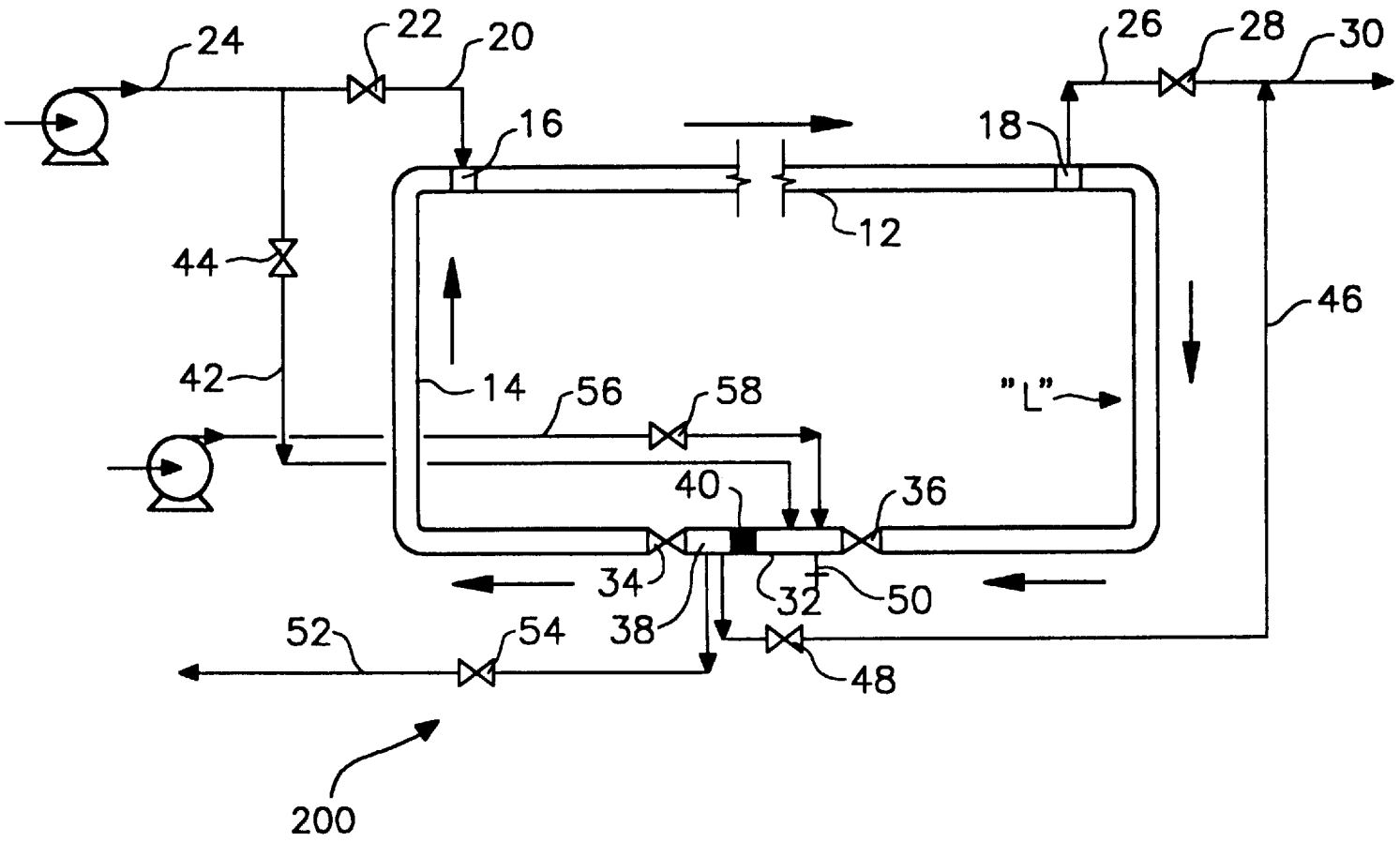
FIGS. 2–7, inclusive, represent diagrammatic layouts of several alternative embodiments of the present invention.

In the case that it is neither acceptable to mix a portion of the process feed fluid with a portion of the process fluid discharged to line 30 nor to mix a portion 0 of the process discharge fluid with a portion of the fluid fed to process tube 12, separate flushing fluid is used to flush chamber 38 which is compatible with both the process feed and discharge fluids. FIG. 2 shows, by way of example, modifications to the embodiment of FIG. 1 which provide means to flush chamber 38 with a separate flushing fluid.

An example process for which the embodiment shown in FIG. 2 is beneficial is the supercritical water oxidation of non-toxic organics with inorganics in an elongate tubular reactor as described in aforesaid U.S. Pat. No. 5,252,224. In said process, high temperatures and reaction conditions dictate that cleaning member 40 be preferably metallic, such as a metal wire brush designed to be propelled by the fluid. The flushing fluid is preferably water and flushing of chamber 38 is performed while the cleaning member is travelling through the process tube, such that a portion of untreated feed fluid will not mix with a portion of treated fluid discharged from the process.

With reference to FIG. 2, the apparatus shown generally as 200 has modifications to FIG. 1 shown as the additions of flushing fluid discharge line 52, controlled by a valve 54, which connects chamber 38 to a flushing fluid discharge point; and a flushing fluid conduit feed line 56, under control of a valve 58, which connects flushing fluid supply to chamber 38.

After launching of member 40 into process tube 12, as described hereinabove, flushing of chamber 38 is effected, if desired, by the opening of valves 58 and 54 to allow sufficient flushing followed by the closing of the same valves, which is in turn followed by preparation for and subsequent receiving of member 40 in chamber 38, as described hereinabove. Flushing of chamber 38 and member 40 while member 40 is in chamber 38 is also effected, if desired, by the opening of valves 58 and 54 to allow sufficient flushing followed by the closing of same valves.

Figure 3:
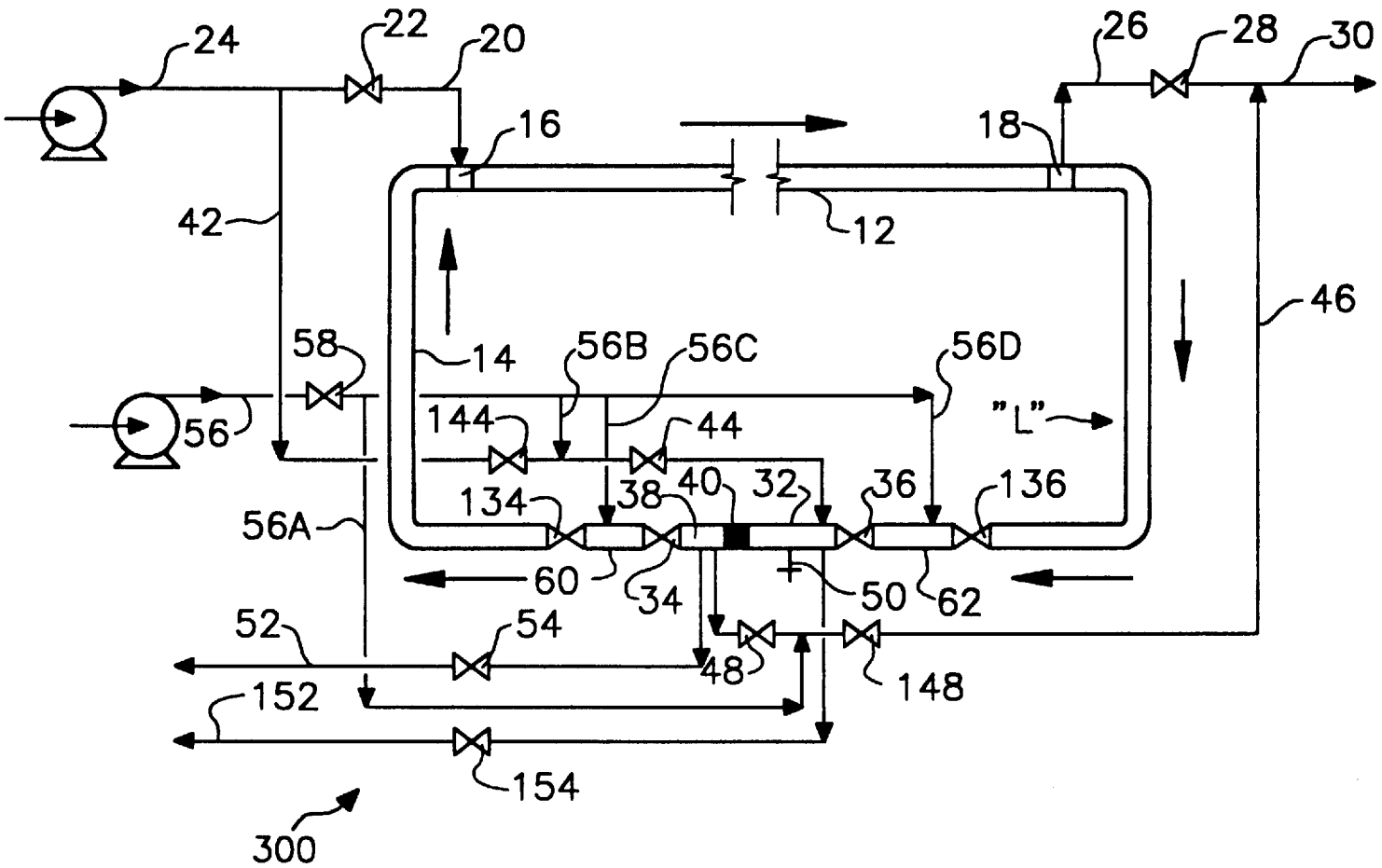
Figure 4:
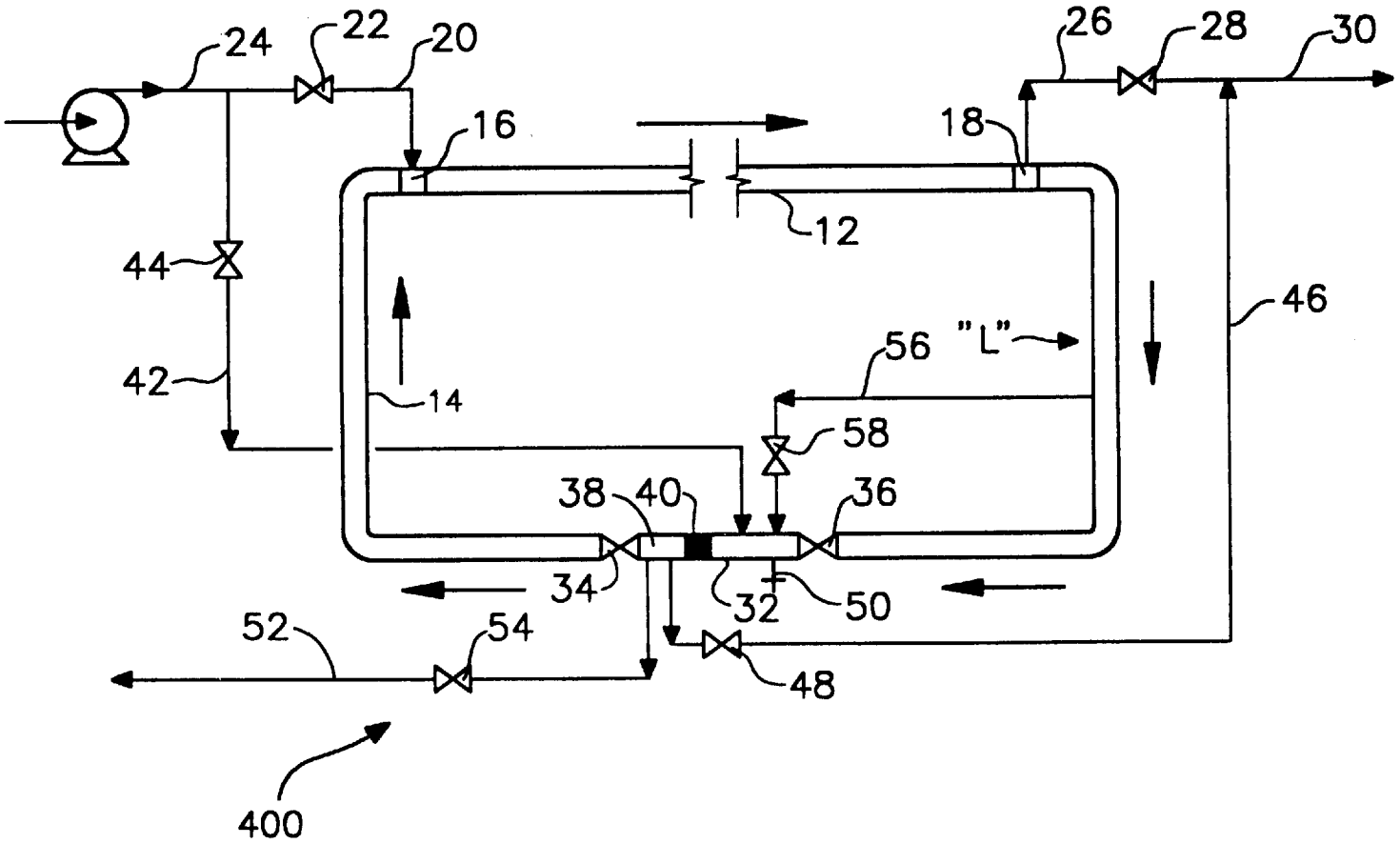
Figure 5:
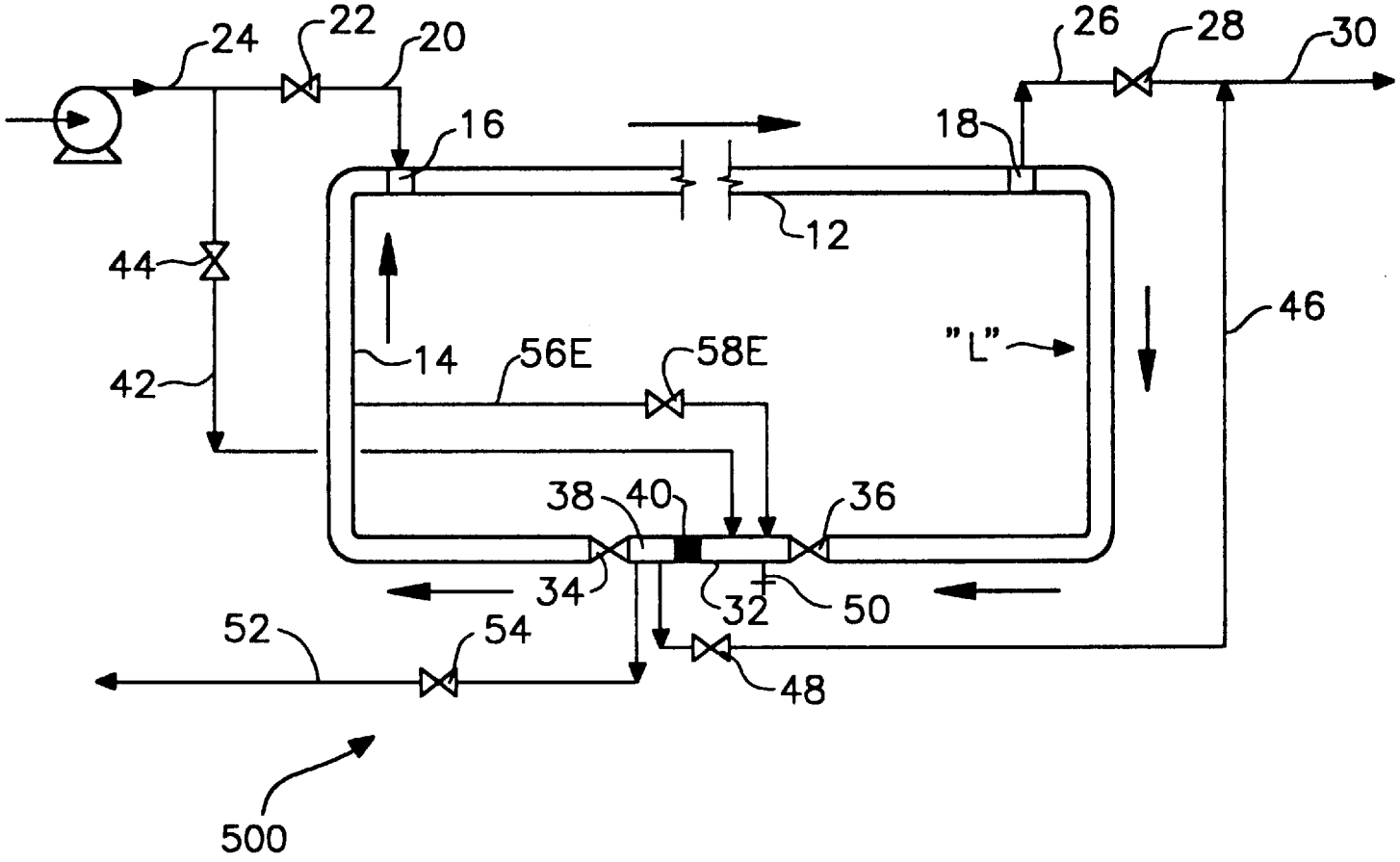

Alternative means of flushing are shown by way of example with reference to FIGS. 3, 4 and 5, showing apparatus generally as 300, 400 and 500, respectively.

With reference to FIG. 3, the modifications shown, which differ from those shown in FIG. 2 in that they allow more complete flushing of chamber 38, are the following additional features. A portion 62 has a valve 136 situated upstream thereof. Conduit 14 has a portion 60 having a valve 134 situated downstream thereof, and a discharge line 46 has a second valve 148 situated downstream of valve 48. Feed line 42 has a second valve 144 situated upstream of valve 44.

Flushing fluid conduit feed line 56, under control of valve 58, splits to form four flushing fluid supply lines 56A, 56B, 56C, and 56D which connect, respectively, to line 46 between valves 48 and 148, line 42 between valves 144 and 44, portion 60 of conduit 14 and portion 62 of conduit 14. Flushing fluid discharge lines 52 and 152, controlled, respectively, by valves 54 and 154, connect, respectively, the downstream and upstream ends of chamber 38 to the flushing fluid discharge point.

An example process for which the embodiment shown in FIG. 3 is beneficial is the supercritical water oxidation of toxic organics with inorganics in an elongate tubular reactor of aforesaid U.S. Pat. No. 5,252,224. As discussed hereinabove, the preferred cleaning member is a metallic brush. The flushing fluid is preferably water and flushing of chamber 38 is performed while the cleaning member is travelling through the process tube, such that a portion of untreated feed fluid will not mix with a portion of treated fluid discharged from the process. More complete flushing of the chamber is required in said example, compared to supercritical water oxidation of nontoxic organics discussed above, since release of even small quantities of toxic organics with the discharge fluid is unacceptable.

Normal operation, cleaning member launching, and cleaning member cleaning are effected in the same manner as that described above for the embodiment of FIG. 1, with the additional requirement that during said operations valves 134, 136, 144 and 148 are synchronized to open and close with valves 34, 36, 44 and 48 respectively.

Normal process flow having been re-established, flushing of chamber 38, or chamber 38 and cleaning member 40 together, is effected by first opening valves 34, 36, 44 and 48, while valves 134, 136, 144 and 148 remain closed, followed by the opening of valves 58, 54, and 154. After sufficient flushing, valves 58, 54 and 154 are closed followed by closing of valves 34, 36, 44 and 48. When cleaning member 40 is in chamber 38 during flushing, it is retained in chamber 38 by, for example, only the partial opening of valves 34 and 36.

For the case wherein it is unacceptable to mix a portion of the process feed fluid with a portion of the fluid discharged to line 30, but it is acceptable to mix a portion of the process discharge fluid with a portion of the fluid fed to process tube 12, the process discharge fluid may be used to flush chamber 38. For example, in the supercritical water oxidation of pulp and paper mill wastes, overall water usage can be reduced by employing the treated discharge from the process as the flush fluid.

A modification to the embodiment shown in FIG. 2, which provides means to flush chamber 38 with the process discharge fluid, is shown by way of example in FIG. 4. In the embodiment shown in FIG. 4, flushing fluid conduit feed line 56, under control of a valve 58, connects conduit 14 between outlet 18 and valve 36. Flushing of chamber 38 as cleaning member 40 travels through process tube 12 is effected by opening valves 58 and 54, while valves 34, 36, 44 and 48 are closed. Following sufficient flushing, valves 58 and 54 are closed.

For the case that it is acceptable to mix a portion of the process feed fluid with a portion of the fluid discharged to line 30, but it is unacceptable to mix a portion of the process discharge fluid with a portion of the fluid fed to process tube 12, the process feed fluid may be used to flush chamber 38.

A modification to the embodiment shown in FIG. 2, which provides means to flush chamber 38 with the process supply fluid, is shown by way of example in FIG. 5. An example of a process for which the embodiment shown in FIG. 5 is beneficial is plug flow fermentation in the process of converting natural sugars to ethanol by action of yeasts. In this process the plug flow reactor (process tube) becomes fouled with organic solids over time and requires periodic cleaning. It is undesirable to mix the product stream with the feed stream in this process as the alcohol in the product stream will inhibit the growth of the yeast, while it is of little consequence to mix a small portion of the feed with the product stream, as it only results a small amount of dilution.

In the embodiment shown in FIG. 5, flushing fluid conduit feed line 56E, under control of a valve 58E, connects with conduit 14 between valve 34 and inlet 16. Flushing of chamber 38 with cleaning member 40 in chamber 38 is effected by opening valves 58E and 54, valves 34, 36, 44 and 48 being closed. Following sufficient flushing valves 58 and 54 are closed.

In operations employing short process tubes an alternative embodiment of the present invention as follows is preferred.

Figure 6:
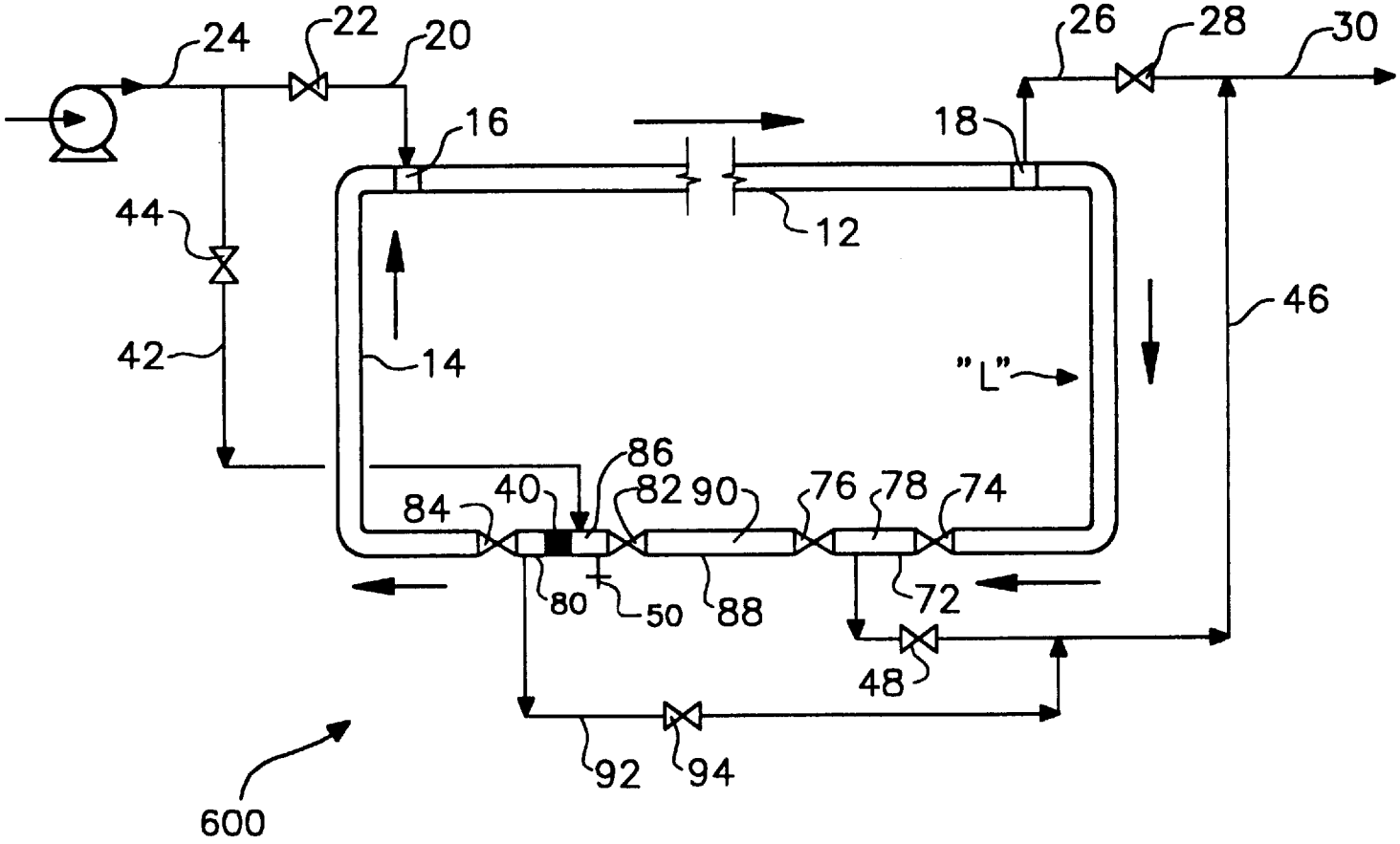

With reference to FIG. 6, this shows generally as 600, apparatus comprising in combination a process tube 12 connected to a recycle conduit 14 to constitute a continuous, recycle loop L. Tube 12 has a supply process fluid inlet 16 and a discharge process fluid outlet 18. Inlet 16 supplies fluid feed via a feed line 20 controlled by a valve 22 from a main feed line 24. Outlet 18 discharges fluid to an outlet line 26 controlled by a valve 28 to a main outlet line 30.

Conduit 14 at a portion 72 has a receiving valve 74 and a transfer valve 76 disposed therefrom, which valves 74 and 76 with portion 72 define a cleaning member receiving and holding chamber 78. Conduit 14 at a portion 80 has a second transfer valve 82 and a launch valve 84 disposed therefrom, which valves 82 and 84 with portion 80 form a cleaning member launching and holding chamber 86. A portion 88 of conduit 14, between valves 76 and 82, forms a cleaning member transfer path 90. In the embodiment shown, member 40 is within launching chamber 86.

A second conduit feed line 42, under control of a valve 44, connects main feed line 24 with launching and holding chamber 86. A second conduit fluid discharge line 46, under control of a valve 48, connects receiving and holding chamber 78 with main outlet line 30. A third conduit discharge line 92, under control of a valve 94, connects launching and holding chamber 86 with main outlet line 30 via outlet line 46. The connecting points of lines 42 and 92 with launching and holding chamber 86, and of line 46 with receiving and holding chamber 78, are such that cleaning member 40 cannot pass from chamber 86 to either line 42 or line 92, or from chamber 78 to line 46. This is accomplished, for example, by a pattern of rods over the connecting points, such that fluid and debris removed from the pipe walls can flow between the rods whereas the cleaning member is too large to pass between the rods.

Chamber 86 has a drain plug 50 through which chambers 78 and 86 along with transfer path 90 may be drained of fluid. In the embodiment shown, member 40 is inserted into or removed from receiving chamber 78 or launching chamber 86 by disassembly of the connections between one of valve 74, 76, 82 or 84 and conduit 14.

The apparatus according to the invention shown in FIG. 6 is suitable for those systems which use a short process tube 12 such that the transit time of cleaning member 40 through tube 12 is brief i.e. wherein there is not sufficient time to carry out the valve operations described above for the embodiment shown in FIG. 1, and for which it is acceptable to have a portion of the supply process fluid mix with a portion of the process fluid discharged to outlet line 30 and in which it is also acceptable to mix a portion of the discharge process fluid with a portion of the fluid supplied to process tube 12. Periodic cleaning of the inner pipe of a double pipe steam condenser, in which the cooling water flows through the inner pipe, is an example of an application when the embodiment shown in FIG. 6 would be beneficial. In this example application, it would be suitable to use a sponge rubber ball or a foam style plug as cleaning member 40.

In operation, cleaning member 40 is inserted into launching and holding chamber 86. Normal process operation is carried out by first closing valves 44, 48, 74, 76, 82, 84 and 94 followed by opening valves 22 and 28, such that process fluid enters process tube 12 at 16, via lines 24, 20, travels through process tube 12 and flows to discharge via lines 26 and 30 after exiting outlet 18.

Periodically, when desired after sufficient period of processing action in tube 12, cleaning of tube 12 is carried out as follows.

In preparation for receiving member 40 in chamber 78, valves 74 and 48 are opened followed by the closing of valve 28. This re-directs process discharge fluid through chamber 78 through line 46 to line 30.

To effect launching of cleaning member 40 from chamber 86, valves 84 and 44 are opened followed by closing of valve 22. This forces fluid through line 42 to chamber 86 and propels member 40 out of chamber 86 and the downstream portion of conduit 14 into process tube 12.

Member 40, after travelling the length of tube 12, is thus propelled by process fluid into chamber 78 and comes to rest against the rear of valve 76. Any debris which has been removed from tube 12 and pushed therethrough by member 40 is carried away by process fluid through lines 46 and 30 to a process discharge point out of line 30.

After member 40 has been received in chamber 78, which event is detected by an appropriate sensing device or viewing window (not shown), valve 22 is reopened followed by the closing of 84 and 44. This effects re-establishment of the process supply fluid flow directly to process tube 12 through line 20.

Transfer of cleaning member 40 from receiving and holding chamber 78 to launching chamber 86 through transfer path 90 is effected by opening valves 76, 82 and 94 followed by closing of valve 48, which allows the process fluid to propel member 40 through path 90.

After member 40 has been propelled to chamber 86, which event is detected by an appropriate sensing device or viewing port (not shown), normal process flow is re-established by opening valve 28 followed by closing valves 74, 76, 82, 84 and 94. Thus, at this point a cleaning and recycling cycle has been completed and the system is ready for another cleaning cycle when required.

Periodically, as wear, corrosion and other detrimental effects dictate, member 40 is replaced either manually or through use of an automatic loading and unloading device or devices (not shown) associated with chambers 78 and 86.

In the case that receiving and holding chamber 78 and launching and holding chamber 86 are closely coupled together, it is obvious that transfer path 90 and transfer valve 82 are not required.

The basic embodiment shown in FIG. 6 can be modified to provide means to allow flushing of undesirable fluids from launching chamber 86 and transfer path 90. An embodiment in which an external flushing fluid is used to both flush chamber 86 and transfer path 90 and to propel member 40 from receiving and holding chamber 78 to launching and holding chamber 86 is shown by way of example in FIG. 7.

Figure 7:
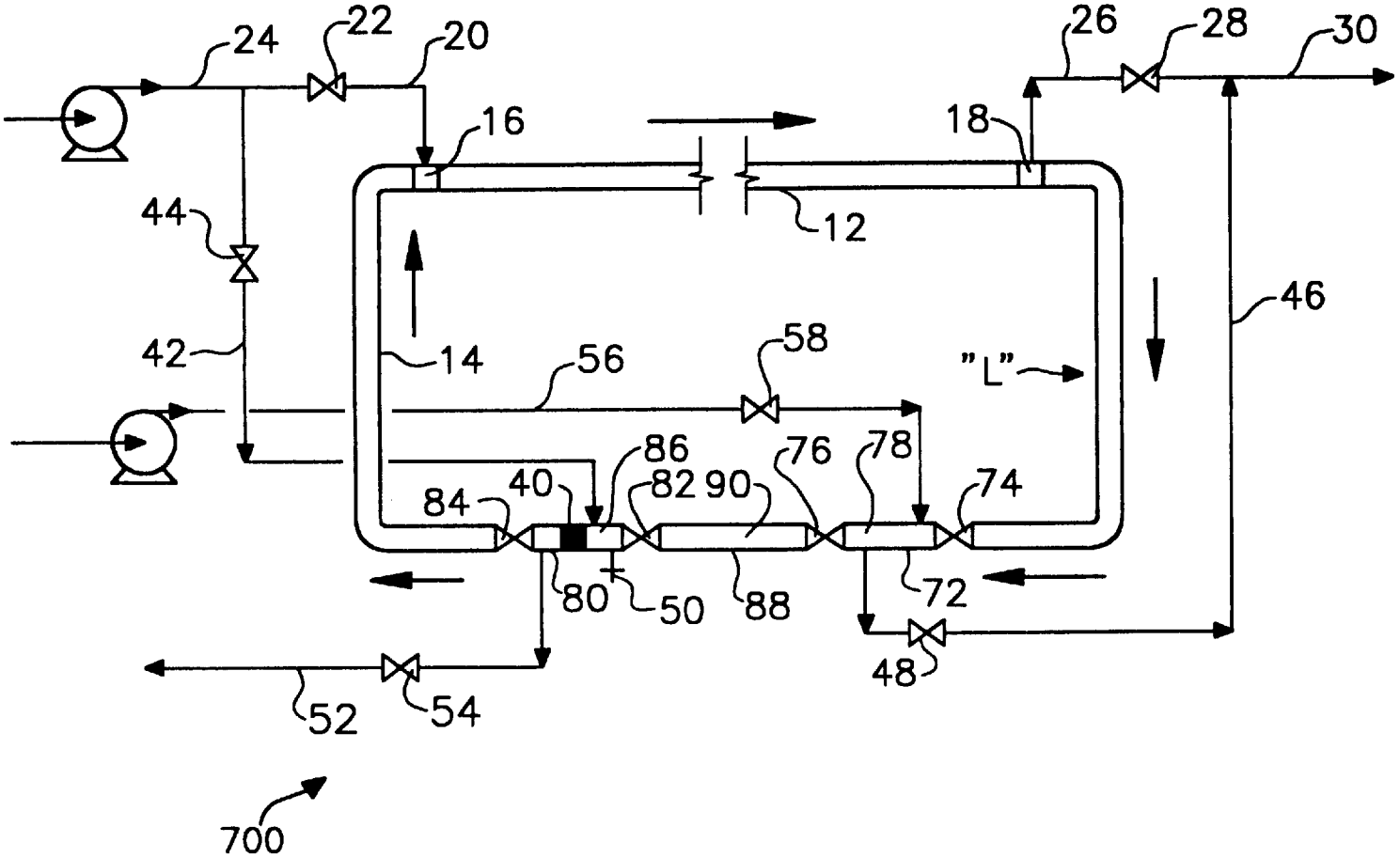

An example process for which the embodiment shown generally as 700 in FIG. 7 is beneficial is the supercritical water oxidation of organics with inorganics in an elongate tubular reactor. In said process high temperatures and reactive conditions dictate that cleaning member 40 be metallic, such as a metal wire brush which is designed to be propelled by the fluid. The flushing fluid is preferably water and flushing of chamber 86 and 90 is performed simultaneously with the transfer of cleaning member 40 from chamber 78 to chamber 86.

The embodiment shown diagrammatically in FIG. 7 differs from that shown in FIG. 6 as follows. The third conduit discharge line 92 is not employed. A flushing fluid conduit feed line 56, under control of a valve 58, connects a flushing fluid supply point to chamber 78. A flushing fluid conduit discharge line 52, under control of a valve 54, connects chamber 86 to flushing fluid discharge point.

Launching of cleaning member 40 from chamber 86 and receiving of said member into chamber 78 are effected as described hereinabove for the embodiment of FIG. 6.

After member 40 has been received in chamber 78, which event is detected by an appropriate sensing device or viewing window (not shown), valves 22 and 28 are reopened followed by the closing of valves 44, 84, 74 and 48, thus effecting re-establishment of normal process fluid flow directly to and from process tube 12 through lines 20 and 26.

Transfer of cleaning member 40 from receiving and holding chamber 78 to launching and holding chamber 86 through transfer path 90 and flushing of chamber 78 and path 90 are effected simultaneously by opening valves 76, 82, 54 and 58.

After member 40 has been transferred to chamber 86, which event is detected by an appropriate sensing device or viewing port (not shown), and sufficient flushing of path 90 and chamber 86 has been effected, valves 54, 82, 76 and 58 are closed. Thus, at this point a cleaning and recycling cycle has been completed and the system is ready for another cleaning cycle when required.

With reference to the basic embodiment shown in FIGS. 6 and 7, it has been demonstrated that cleaning member 40 can be transferred from chamber 78 to chamber 86 by either using the process discharge fluid or a separate flushing fluid. An obvious extension is to use the process supply fluid to transfer cleaning member 40 from chamber 78 to chamber 86.

A means of flushing chamber 86 and path 90 has been presented by way of example in FIG. 7.

Figure 8:
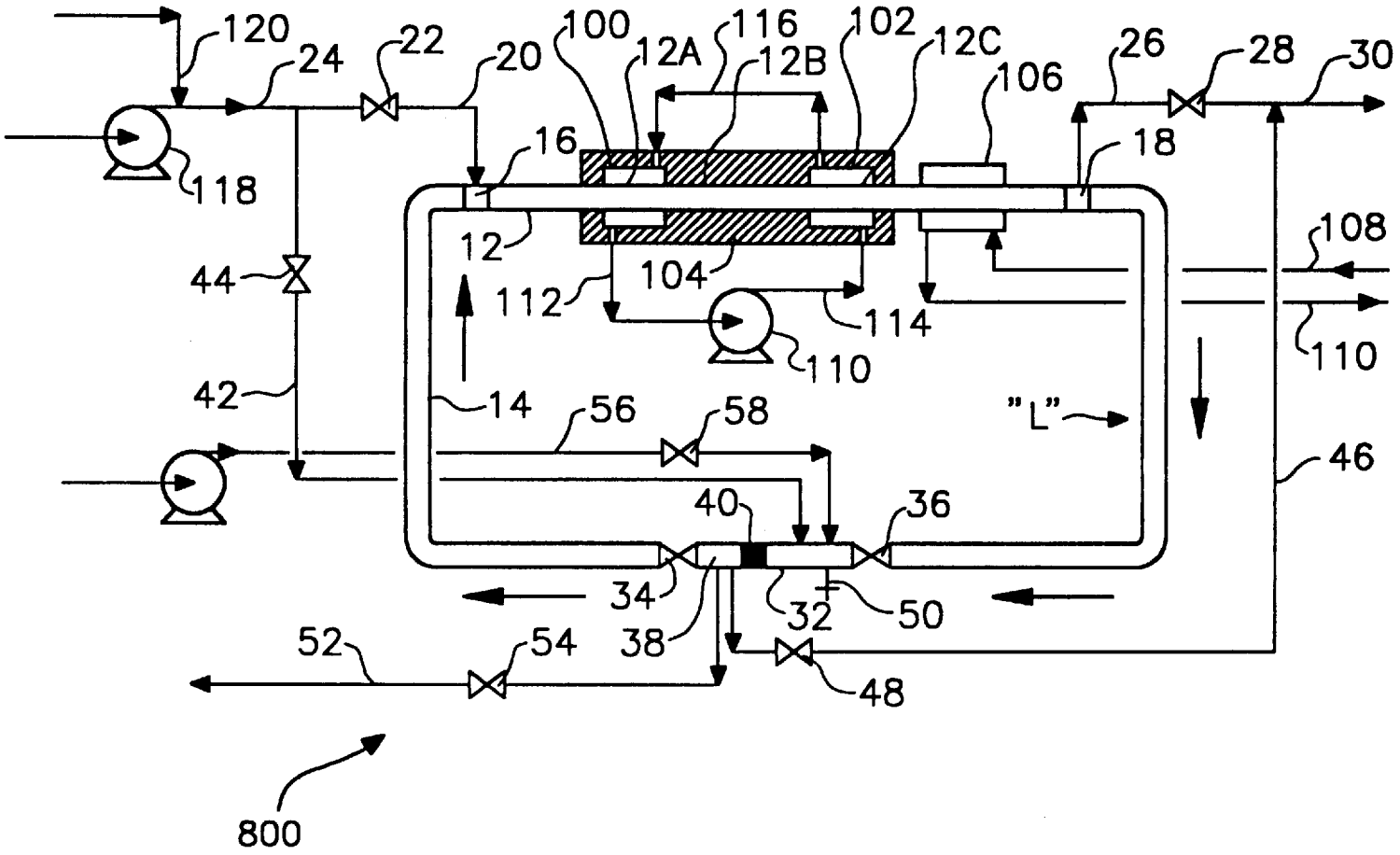
FIG. 8 represents, in part, a diagrammatic layout of a further embodiment of the invention wherein the process tube is constituted as part of a supercritical water oxidation tubular reactor.

With reference to FIG. 8, process tube 12 at a portion 12A is provided with a heating jacket 100, and at portion 12C with a cooling jacket 102. Between tube portions 12A and 12C process tube 12 has an adiabatic tubular reactor portion 12B. Heating jacket 100, cooling jacket 102 and tube portion 12B are thermally insulated by insulation 104. A further cooling jacket 106, having cooling fluid supply line 108 and cooling fluid discharge line 110, is provided adjacent outlet 18. Heating jacket 100 and cooling jacket 102 with pump 110 and heat transfer fluid conduits 112, 114 and 116 comprise a heat recovery loop. Line 24 has a pump 118 and an oxygen containing gas supply line 120.

In operation, with process tube 12 constituting a supercritical water oxidation tubular reactor of the type referred to in aforesaid U.S. Pat. No. 5,252,224 for the oxidation of organic material, a supply of oxygen is fed through lines 120, 24 and 20 and organic material in an aqueous medium through lines 24 and 20 to tube 12.

Combined oxygen-organic aqueous mixture is heated in tube portion 12A, reacted in tube portion 12B and the resultant mixture cooled by heat exchangers 102 and 106.

Although this disclosure has described and illustrated certain preferred embodiments of the invention, it is to be understood that the invention is not restricted to those particular embodiments. Rather, the invention includes all embodiments which are functional or mechanical equivalence of the specific embodiments and features that have been described and illustrated.

We claim:

1. Apparatus of use in combination with a process tube for the periodic cleaning of said process tube, said process tube having feed process fluid supply means for receiving a feed process fluid and discharge process fluid discharge means for discharging process fluid, said apparatus comprising:

a cleaning member;

a cleaning member recycling conduit in communication with said process tube to form a recycle loop therewith, said recycling conduit and said process tube being adapted to receive said cleaning member to allow said member to operably circulate therethrough under process fluid flow to effect cleaning of said process tube; wherein said recycling conduit has first valve means and second valve means defining therebetween with a portion of said conduit a first cleaning member receiving, holding and launching chamber, elongated tubes connecting each of said first and second valve means to input and output portions respectively of said process tube, and means for flushing said first chamber comprising a first flushing fluid conduit feed line and a first flushing fluid discharge line connected to said discharge process fluid discharge means, both said lines being in direct communication with said first chamber;

process fluid flow pump means external of said recycle loop to effect said process fluid flow, such that said process fluid flow is provided only by said external pump means;

control means for moving said cleaning member in and out of said first chamber, said control means constituted by said first and second valve means by third and fourth valve means located in said first flushing fluid conduit feed line and said first flushing fluid discharge line, respectively; wherein said recycle conduit has fifth valve means and sixth valve means defining therebetween with a portion of said conduit a second cleaning member receiving, holding and launching chamber and means for flushing said second cleaning member chamber comprising a second flushing fluid discharge line.

2. Apparatus as defined in claim 1 further comprising second feed process fluid supply means in communication with said first chamber and second discharge process fluid discharge means in communication with said first chamber.

3. Apparatus as defined in claim 2 wherein said feed process fluid supply means comprises first feed inlet means, a first feed line and first feed valve means; and said second flushing fluid discharge line comprises a second discharge outlet means and a second discharge valve means.

4. Apparatus as defined in claim 1 further comprising cleaning fluid supply means in communication with said first chamber and comprising a cleaning fluid supply line, cleaning fluid supply chamber inlet means and cleaning fluid discharge chamber outlet means.

5. Apparatus as defined in claim 4 wherein said cleaning fluid supply line is in communication with said conduit.

6. Apparatus as defined in claim 5 wherein said cleaning fluid supply line is in communication with said conduit upstream of said second chamber.

7. Apparatus as defined in claim 1 wherein said process tube is an elongate tubular reactor.

8. Apparatus as defined in claim 7 wherein said elongate tubular reactor is suitable for the oxidation of organic material with a source of oxygen in an aqueous reaction mixture at least at the critical temperature and critical pressure for water.

9. Apparatus as defined in claim 7 wherein said tubular reactor comprises means for the oxidation of organic material with a source of oxygen in an aqueous reaction mixture at least at the critical temperature and critical pressure of water; and means for feeding said aqueous reaction mixture and said source of oxygen to said tubular reactor.

* * * * *